US008768211B2

(12) United States Patent
Hayashi et al.

(10) Patent No.: US 8,768,211 B2
(45) Date of Patent: Jul. 1, 2014

(54) DEVELOPING CARTRIDGE HAVING A DETACHABLE COVER

(75) Inventors: Naoki Hayashi, Mishima (JP); Tetsuya Numata, Suntou-gun (JP); Tetsushi Uneme, Susono (JP); Yuuki Nakamura, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 604 days.

(21) Appl. No.: 12/913,220

(22) Filed: Oct. 27, 2010

(65) Prior Publication Data

US 2011/0103835 A1 May 5, 2011

(30) Foreign Application Priority Data

Oct. 30, 2009 (JP) ..... 2009-250619
Oct. 30, 2009 (JP) ..... 2009-250706

(51) Int. Cl.
*G03G 15/08* (2006.01)
*G03G 15/01* (2006.01)

(52) U.S. Cl.
CPC ..... *G03G 15/0121* (2013.01); *G03G 15/0896* (2013.01); *G03G 2221/1815* (2013.01); *G03G 2215/0177* (2013.01); *G03G 2215/0877* (2013.01)
USPC ..... 399/119; 399/227

(58) Field of Classification Search
CPC ..... G03G 15/0121; G03G 15/0896; G03G 2221/1815; G03G 2215/0877; G03G 2221/163; G03G 2215/0177
USPC ..... 399/111, 114, 119, 227
See application file for complete search history.

(56) References Cited

U.S. PATENT DOCUMENTS 4,974,023 A * 11/1990 Aimoto et al. ..... 399/119
2010/0054797 A1 3/2010 Takeyama et al.

FOREIGN PATENT DOCUMENTS

JP 2000075770 A * 3/2000 ..... G03G 21/18
JP 2002182541 A * 6/2002 ..... G03G 21/18
JP 2003-173076 A 6/2003
JP 2003-195730 A 7/2003
JP 2004280012 A * 10/2004 ..... G03G 21/18
JP 2006-39314 A 2/2006
JP 2006039314 A * 2/2006

* cited by examiner

*Primary Examiner* — David Gray
*Assistant Examiner* — Laura Roth
(74) *Attorney, Agent, or Firm* — Fitzpatrick, Cella, Harper & Scinto

(57) ABSTRACT

A developing cartridge is detachably mountable to a main assembly of an image forming apparatus, and includes a frame, a developer carrying member, a first portion to be engaged provided on one side of the frame, and a second portion to be engaged provided on the other side of the frame with respect to the direction crossing the axial direction of the developer carrying member. In addition, a cover member includes a first engaging portion engageable with the first portion to be engaged and a second engaging portion engageable with the second portion to be engaged for covering an exposed portion of the developer carrying member by being detachably mounted to the frame. The cover member is detachably mountable to the frame in a first state by engaging the first engaging portion with the first portion to be engaged and by engaging the second engaging portion with the second portion to be engaged.

19 Claims, 11 Drawing Sheets

(a)

(b)

(a)

(b)

(a)

(b)

DEVELOPING CARTRIDGE HAVING A DETACHABLE COVER

FIELD OF THE INVENTION AND RELATED ART

The present invention relates to a developing cartridge detachably mountable to an image forming apparatus of an electrophotographic type, such as a copying machine, a printer or a facsimile machine.

Here, the developing cartridge at least includes a developer carrying member for carrying and feeding a developer for developing an electrostatic latent image formed on an image bearing member which is an electrophotographic photosensitive member, and is detachably mountable to a main assembly of the image forming apparatus.

In the image forming apparatus, the electrostatic latent image formed on a drum-like electrophotographic photosensitive member as the image bearing member (hereinafter referred to as a photosensitive drum) is developed by a developing means, thus being visualized as a toner image.

In a conventional image forming apparatus using an electrophotographic image forming process, the developing cartridge as the developing means includes a toner accommodating portion for accommodating the developer (toner). Further, the developing cartridge is provided, in the toner accommodating portion, with the developer carrying member for developing the electrostatic latent image formed on the photosensitive drum (hereinafter referred to as a developing roller). These members are integrally assembled as the developing cartridge which is detachably mountable to a main assembly of the image forming apparatus.

The thus detachably mountable developing cartridge is exchanged by a user. At this time, the user dismounts the developing cartridge from the main assembly of the image forming apparatus and then mounts a fresh developing cartridge into the main assembly in general.

Here, to the fresh developing cartridge, a cover member for protecting the developing roller is attached. During the mounting of the developing cartridge in the main assembly, the user detaches the cover member from the developing cartridge and mounts the developing cartridge into the main assembly.

Further, the detached cover member is attached to the developing cartridge which has been used and dismounted from the main assembly of the image forming apparatus, so that the developing cartridge and the cover member can be collected simultaneously and recycled.

With respect to the cover member which is attached to the developing cartridge and is configured to protect the developing roller, a constitution disclosed in Japanese Laid-Open Patent Application (JP-A) 2003-173076 has been known.

When the detached cover member can be attached to the developing cartridge which has been used and dismounted from the image forming apparatus main assembly and can be collected for re-utilizing parts of the developing cartridge, limited resources can be effectively utilized.

Further, in the case where the developing cartridge is transported for reuse, damage on the surface of the developing roller exposed from the developing cartridge is required to be prevented. For this reason, it is desirably that the cover member, for covering the developing roller surface, which has been attached to the fresh developing cartridge is attached to the detached developing cartridge and then is sent back by the user.

The conventional cover member described above is capable of covering an entire exposed area of the developing roller exposed from the developing cartridge and is capable of being detached from the developing cartridge. Further, a plurality of engaging portions between the developing cartridge and the cover member is provided at end portions of the developing roller with respect to an axial direction (i.e., a longitudinal direction) of the developing roller or at portions along the longitudinal direction of the developing roller. For this reason, when the user attaches the cover member to the developing cartridge after use, the user is required to properly engage the engaging portions in a state which is the exactly same as the state in which the cover member has been attached to the fresh developing cartridge. For that reason, there was a possibility that the user was unable to attach the cover member to the developing cartridge easily.

SUMMARY OF THE INVENTION

A principal object of the present invention is to provide a developing cartridge, to which a cover member is attached, having good usability.

According to an aspect of the present invention, there is provided a developing cartridge detachably mountable to a main assembly of an image forming apparatus, the developing cartridge comprising:

a frame;

a developer carrying member, provided on the frame, for carrying a developer for developing an electrostatic image;

a first portion to be engaged provided on one side of the frame with respect to a direction crossing an axial direction of the developer carrying member;

a second portion to be engaged provided on the other side of the frame with respect to the direction crossing the axial direction of the developer carrying member; and a cover member, including a first engaging portion engaging with the first portion to be engaged and including a second engaging portion engaging with the second portion to be engaged, for covering an exposed portion of the developer carrying member by being detachably mounted to the frame, wherein the cover member is detachably mountable to the frame by engaging the first engaging portion with second portion to be engaged and by engaging the second engaging portion with the first portion to be engaged.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, the developing cartridge according to the present invention will be described in detail with reference to the drawings.

Embodiment 1

Figure 1:
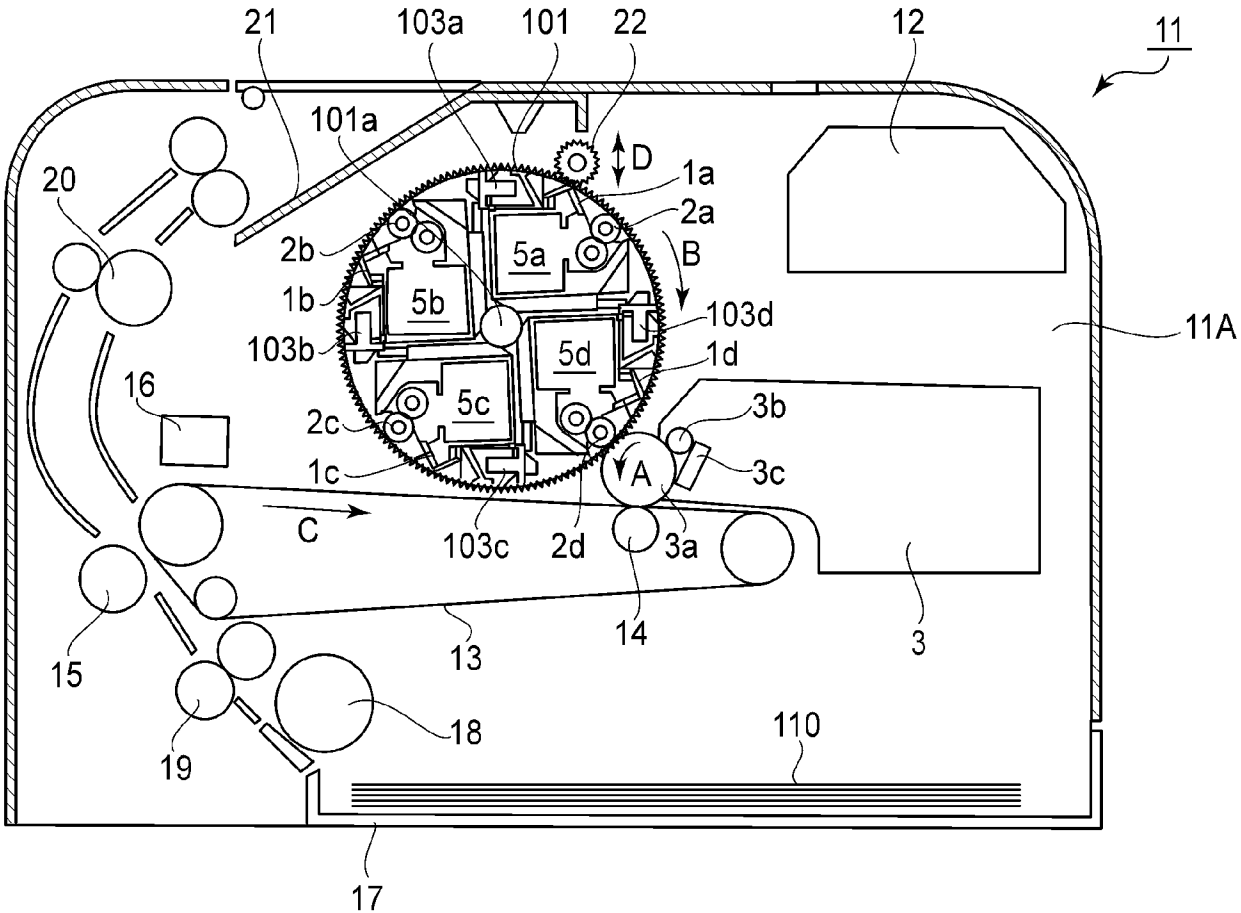
FIG. 1 is a schematic sectional view of an example of an image forming apparatus to which a developing cartridge according to the present invention is detachably mountable.

FIG. 1 shows an embodiment of a so-called rotary type color electrophotographic image forming apparatus including a rotary in which a plurality of developing cartridges is mountable.

(General Structure of Image Forming Apparatus)

First, a general structure and an image forming operation of the image forming apparatus will be described with reference to FIG. 1.

An image forming apparatus 11 in this embodiment is a four color-based full-color laser beam printer. FIG. 1 is a sectional view showing a schematic structure of the image forming apparatus 11.

As shown in FIG. 1, the image forming apparatus 11 includes a drum-like electrophotographic photosensitive member as an image bearing member, i.e., a photosensitive drum 3*a*. At a periphery of the photosensitive drum 3*a*, a charging means 3*b* for uniformly charging the photosensitive drum 3*a* and an exposure means 12 for forming a latent image on the photosensitive drum 3*a* by irradiating the surface of the photosensitive drum 3*a* with laser light are disposed. Further, as a developing means, a plurality of developing cartridges 5 (5*a* to 5*d*) each for developing the latent image formed on the photosensitive drum 3*a* with a developer (toner) of an associated color is disposed adjacently to the photosensitive drum. In this embodiment, the plurality of developing cartridges 5 include to a yellow developing device 5*a*, a magenta developing device 5*b*, a cyan developing device 5*c* and a black developing device 5*d*. Further, at the periphery of the photosensitive drum 3*a*, a cleaning means 3*c* for removing residual toner on the photosensitive drum 3*a* is disposed.

In this embodiment, the photosensitive drum 2*a*, the charging means 2*b* and the cleaning means 2*c* are integrally constituted and are assembled into a drum cartridge 2, which is detachably mountable to the image forming apparatus main assembly 11A and is employed.

The yellow developing cartridge 5*a*, the magenta developing cartridge 5*b*, the cyan developing cartridge 5*c* and the black developing cartridge 5*d* include developer carrying members, i.e., developing rollers 2 (2*a*, 2*b*, 2*c* and 2*d*), respectively. The developing cartridges 5 (5*a*, 5*b*, 5*c* and 5*d*) are held by a rotary 101 rotatably mounted in the apparatus main assembly 1.

The rotary 101 has the same holding constitution with respect to all of the yellow developing cartridge 5*a*, the magenta developing cartridge 5*b*, the cyan developing cartridge 5*c* and the black developing cartridge 5*d*. Therefore, in this embodiment, the developing cartridge holding constitution of the rotary 101 will be described with respect to the yellow developing cartridge 5*a*.

Figure 2:
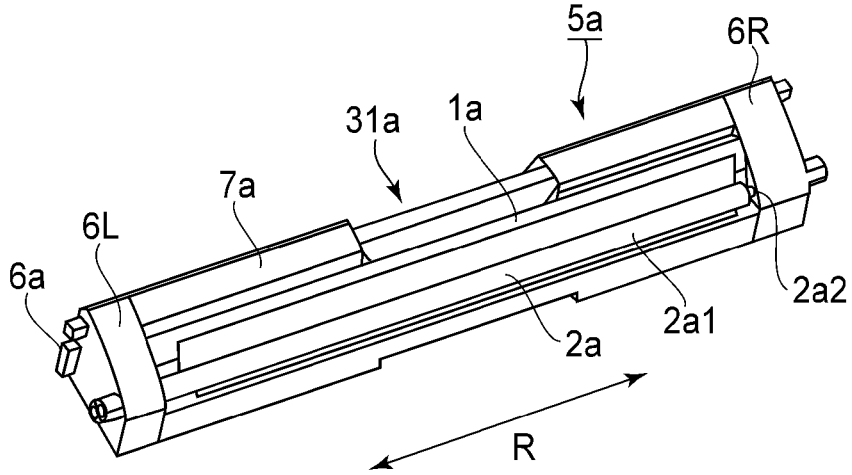
FIG. 2 is a perspective view of an outer appearance of an embodiment of the developing cartridge of the present invention.

When the yellow developing cartridges 5*a* is mounted in the rotary 101, portion to be locked 6*a* (FIG. 2) engages with a developing cartridge locking member 103*a* (FIG. 1) provided in the rotary 101. As a result, the yellow developing cartridge 5*a* is supported by the rotary 101. The developing cartridge locking member 103*a* engages with the yellow developing cartridge 5*a* by a spring (not shown) to prevent movement of the rotary 101 in a direction indicated by an arrow D in FIG. 1.

In the same manner as in the case of the yellow developing cartridge 5*a*, the magenta developing cartridge 5*d*, the cyan developing cartridge 5*c* and the black developing cartridge 5*d* are similarly supported.

An operation of image formation will be described below.

First, the photosensitive drum 3*a* is rotated in a direction indicated by an arrow A in FIG. 1. In synchronism with rotation of the photosensitive drum 3*a*, an intermediary transfer belt 13 in a direction indicated by an arrow C in FIG. 1. Then, the surface of the photosensitive drum 3*a* is uniformly charged by the charging means 3*b* and at the same time is irradiated with light for a yellow image by the exposure means 12, so that an electrostatic latent image for yellow is formed on the photosensitive drum 3*a*.

In synchronism with this formation of the electrostatic latent image, the rotary 101 which holds the developing cartridges 5 (5*a* to 5*d*) and is rotatable is rotated about a rotary rotational axis (rotation shaft) 101*a* in the direction indicated by an arrow B in FIG. 1 by a drive transmission mechanism 22 provided in the image forming apparatus 11. By the rotation of the rotary 101, the yellow developing cartridge 5*a* is disposed at a developing position in which the yellow developing cartridge 5*a* opposes the photosensitive drum 3*a* as shown in FIG. 3.

Then, a potential difference is provided between the photosensitive drum 3*a* and a developing roller 2*a* so that a yellow developer is deposited on the latent image formed on the photosensitive drum 3*a*. As a result, the latent image formed on the photosensitive drum 3*a* is developed by depositing the yellow developer thereon. That is, a yellow toner image is formed on the photosensitive drum 3*a*.

Thereafter, by applying a voltage of an opposite polarity to the toner charge polarity to a primary transfer roller 14 disposed inside the intermediary transfer belt 13, the yellow toner image is primary-transferred from the photosensitive drum 3*a* onto the intermediary transfer belt 13.

Figure 3:
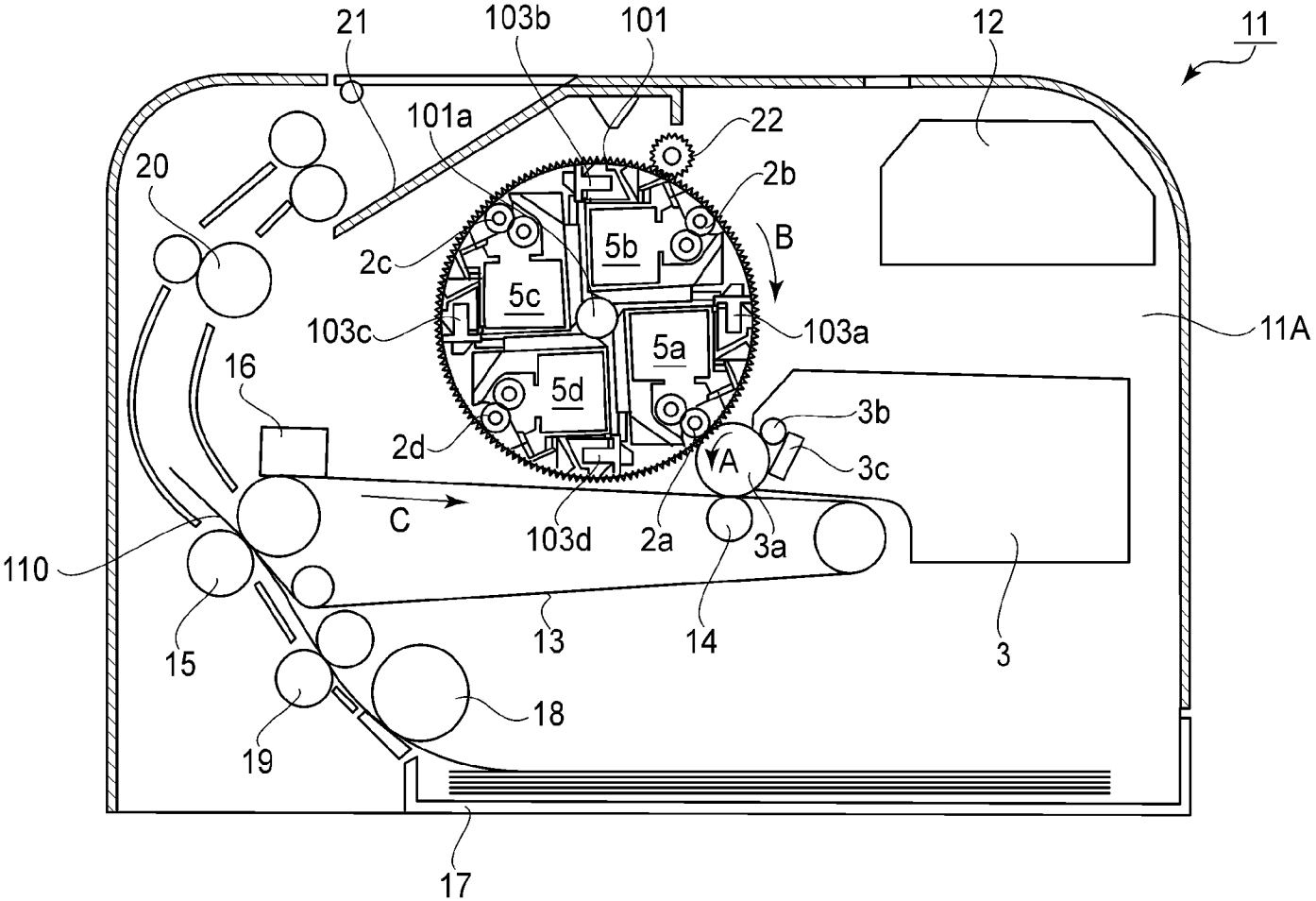
FIG. 3 is a schematic view of the image forming apparatus shown in FIG. 1 during image formation.

In the above-described manner, when the primary transfer of the yellow toner image is completed, the rotary 101 is rotationally moved in the arrow B direction in FIG. 3 by receiving a driving force from the drive transmission mechanism 22 of the image forming apparatus 11. Then, the magenta developing cartridge 5*b*, the cyan developing cartridge 5*c* and the black developing cartridge 5*d* are successively positioned at the developing position in which the positioned developing cartridge opposes the photosensitive drum 3*a*.

Similarly as in the case of yellow, with respect to each of the colors of magenta, cyan and black, the formation of the electrostatic latent image, the development of the electrostatic latent image and the primary transfer are successively performed, so that four color toner images are superposed on the intermediary transfer belt 13.

During this image forming operation, as shown in FIG. 1(*a*), a secondary transfer roller 15 is in non-contact with the intermediary transfer belt 13. Further, at that time, a cleaning unit 16 for the intermediary transfer belt 13 is also in non-contact with the intermediary transfer belt 13.

On the other hand, sheets 110 which are a material (medium) onto which the toner images are transferred, i.e., a recording material are stacked and accommodated in a sheet feeding cassette 17 provided at a lower portion of the image forming apparatus 11 and are separated and fed one by one from the sheet feeding cassette 17 by a sheet feeding roller 18, thus being fed to conveying rollers 19. The conveying rollers 19 send the fed sheet S between the intermediary transfer belt 13 and the secondary transfer roller 15. Here, as shown in FIG. 3, the secondary transfer roller 15 is in a state in which it press-contacts the intermediary transfer belt 13.

Further, the voltage of the opposite polarity to the toner charge polarity has been applied to the secondary transfer roller 15, so that the above-described four color toner images superposed on the intermediary transfer belt 13 are collectively secondary-transferred onto the surface of the conveyed sheet 110.

The sheet 110 on which the toner images are transferred is sent to a fixing device 20. In the fixing device 20, the sheet 110 is subjected to heat and pressure, so that the toner images are fixed on the sheet 110. Thereafter, the sheet 110 is discharged from the fixing device 20 to a sheet discharge portion 21 outside the image forming apparatus 11.

(Developing Cartridge)

With respect to the developing cartridges 5, all the constitutions of the yellow developing cartridge 5*a*, the magenta developing cartridge 5*b*, the cyan developing cartridge 5*c* and the black developing cartridge 5*d* are the same. Therefore, the description of the constitutions of the respective developing cartridges will be made with respect to the yellow developing cartridge 5*a*. The yellow developing cartridge 5*a* in this embodiment will be described with reference to FIGS. 4(*a*), 4(*b*), 5(*a*) and 5(*b*).

Figure 4:
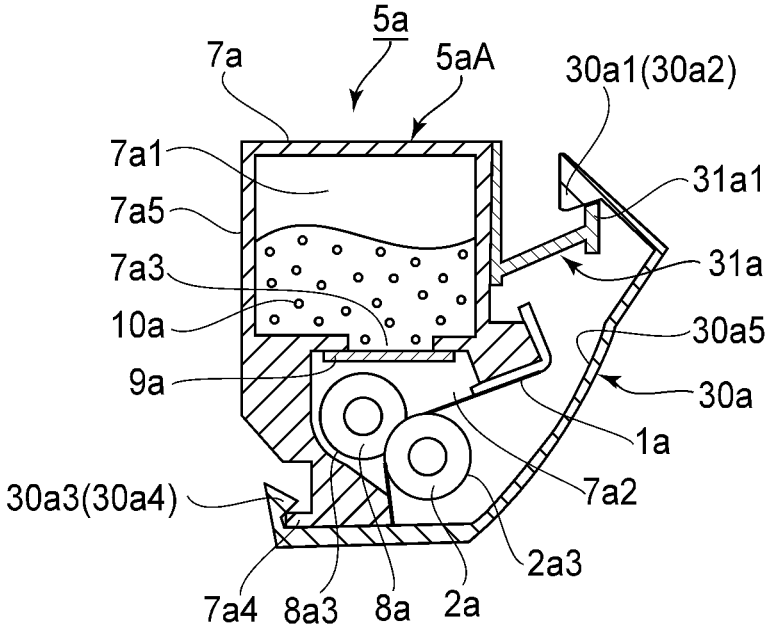
FIGS. 4(*a*) and 4(*b*) are schematic sectional views of the developing cartridge of the present invention, in which FIG. 4(*a*) shows a state in which a cover member is mounted and FIG. 4(*b*) shows a state in which the cover member is removed.
Figure 4:
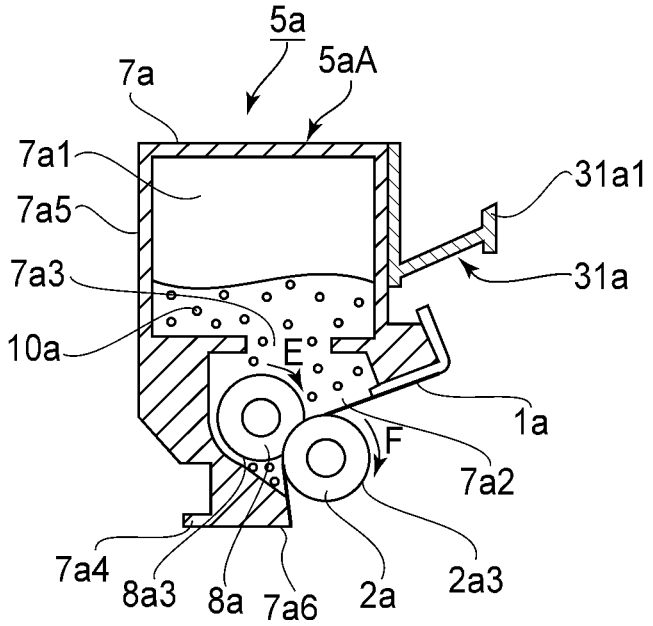

FIGS. 4(*a*) and 4(*b*) are sectional views of the yellow developing cartridge 5*a* as seen in a direction perpendicular to the longitudinal direction of the yellow developing cartridge 5*a*, i.e., the longitudinal direction passing through a grip portion 31*a* provided on the yellow developing cartridge 5*a* in the neighborhood of a central portion with respect to the axial direction of the yellow developing cartridge 5*a*.

The yellow developing cartridge 5*a* includes a developing cartridge frame 5*a*A. The developing cartridge frame 5*a*A constitutes a developer container 7*a* as a toner accommodating portion for accommodating the developer (toner) and rotatably holds the developing roller 2*a* or the like for carrying and feeding the toner, thus integrally assembling these members into a unit. The developer container 7*a* of the yellow developing cartridge 5*a* is separated into a toner accommodating chamber 7*a*1 and a developing chamber 7*a*2 including the developing roller 2*a* and a toner feeding roller 8*a*. These chambers 7*a*1 and 7*a*2 are connected by a toner feeding opening 7*a*3.

A developing roller outer surface 2*a*3 of the developing roller 2*a* and a toner feeding roller outer surface 8*a*3 of the toner feeding roller 8*a* are disposed so as to contact each other in the developing chamber 7*a*2.

Figure 5:
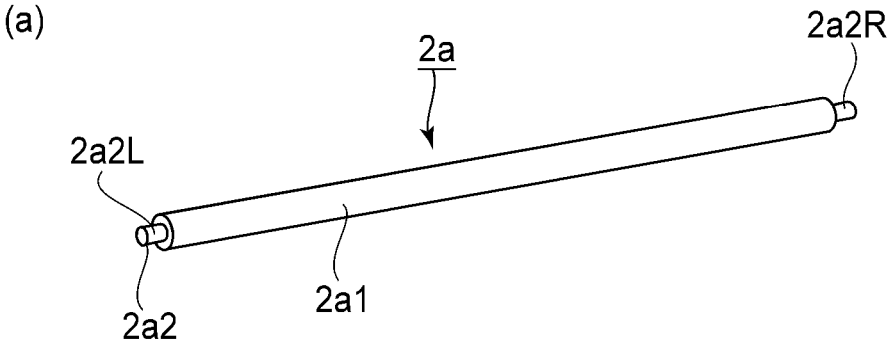
FIGS. 5(*a*) and 5(*b*) are schematic perspective views, in which FIG. 5(*a*) shows a developing roller and FIG. 5(*b*) illustrating a manner in which the developing roller is mounted to the developing cartridge.
Figure 5:
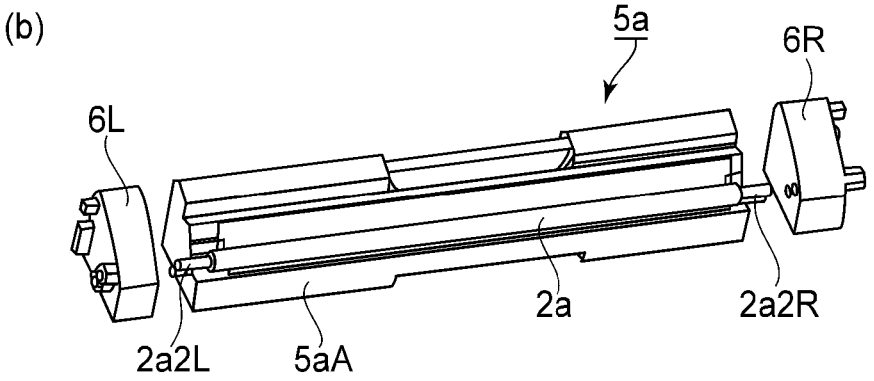

The developing roller 2*a* is, as shown in FIG. 5(*a*), constituted by a rubber roller portion 2*a*1 and a rigid member shaft 2*a*2. The rigid member shaft 2*a*2 penetrates through the rubber roller portion 2*a*1 with respect to a rotational axis direction of the developing roller 2*a*, so that protruded portions 2*a*2L and 2*a*2R protruded from the rubber roller portion 2*a*1 at both end portions of the portion 2*a*1.

A constitution in which the developing roller 2*a* of the yellow developing cartridge 5*a* is rotatably supported by the frame 5*a*A will be described with reference to FIG. 5(*b*).

In this embodiment, the yellow developing cartridge 5*a* rotatably holds the developing roller 2*a* by side members 6L and 6R which are provided on both sides of the frame 5*a*A and hold the protruded portions 2*a*2L and 2*a*2R of the developing roller 2*a*.

Further, in this embodiment, in an unused state until the yellow developing cartridge 5*a* is delivered to the user, as shown in FIG. 4(*a*), at the toner feeding opening 7*a*3, a film-like toner seal 9*a* is fixed to the developing container 7 by welding.

Figure 6:
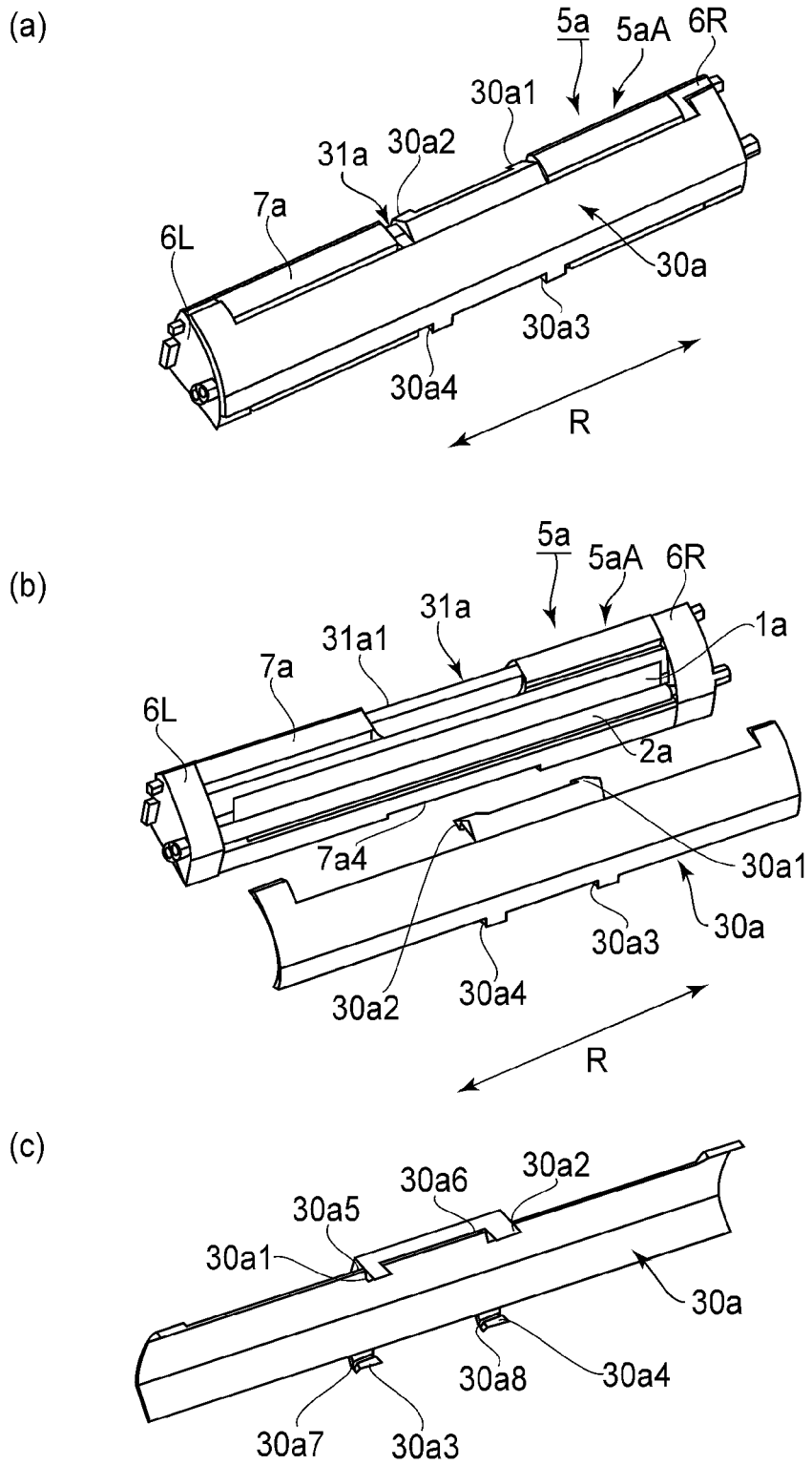
FIGS. 6(*a*), 6(*b*) and 6(*c*) are schematic perspective views, in which FIG. 6(*a*) shows the developing cartridge of the present invention and the cover member, FIG. 6(*b*) shows a state in which the cover member is removed from the developing cartridge, and FIG. 6(*c*) shows the removed cover member.

Further, as is understood from FIG. 4(*b*), a part of the rubber roller outer surface 2*a*3 of the developing roller 2*a* is exposed from the yellow developing cartridge 5*a*, so that the user can directly touch the exposed portion with hand. For that reason, as shown in FIG. 6(*a*), in the unused state, a cover member 30*a* for covering the entire exposed portion of the rubber roller outer surface 2*a*3 is provided. By detaching this cover member 30*a*, the rubber roller outer surface 2*a*3 is exposed and contacts the photosensitive drum 3*a* in the image forming apparatus 11 as shown in FIG. 3.

In FIG. 4(*b*), toner 10*a* in the developing chamber 7*a*2 is fed to the toner feeding roller 8*a*, which is rotated in a direction indicated by an arrow Z in FIG. 4(*b*) to feed the toner 10*a* to the developing roller 2*a*. The developing roller 2*a* is rotated in a direction indicated by an arrow F in FIG. 4(*b*), so that the toner 10*a* on the developing roller 2*a* is regulated by a developing blade 1*a*. Then, at a position in which the developing roller 2*a* opposes the photosensitive drum 3*a*, the toner 10*a* is subjected to development. Thereafter, the toner 10*a* left on the developing roller 2*a* is removed by and fed to the toner feeding roller 8*a*. To the developing roller 2*a*, a voltage is supplied from the image forming apparatus 11 so as to provide the potential difference between itself and the photosensitive drum 3*a*. Also to the toner feeding roller 8*a*, the voltage is supplied from the image forming apparatus 11.

(Engagement Between Cover Member and Developing Cartridge)

A constitution of the engagement between the cover member and the developing cartridge will be described with reference to FIGS. 6(*a*), 6(*b*), 7, 8(*a*) and 8(*b*). The engaging constitution between the cover member and the developing cartridge is similarly employed also with respect to other developing cartridges, i.e., the magenta developing cartridge 5*b*, the cyan developing cartridge 5*c* and the black developing cartridge 5*d*. Therefore, the description of the engaging constitution between the cover member and the developing cartridge will be made with respect to the yellow developing cartridge 5*a* and the cover member 30*a* to be attached to the yellow developing cartridge 5*a*.

Figure 7:
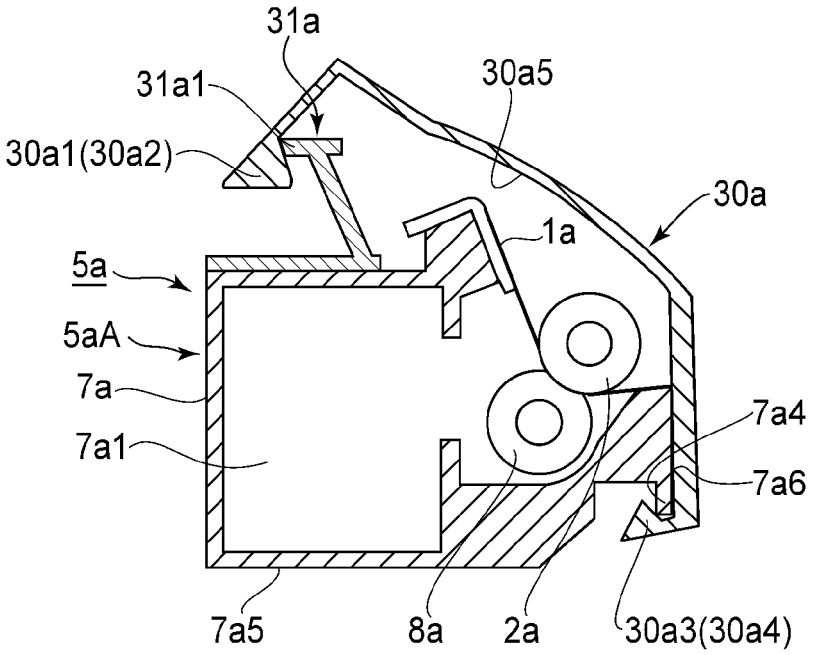
FIG. 7 is a schematic sectional view showing the developing cartridge of the present invention in a state in which the cover member is attached.
Figure 8:
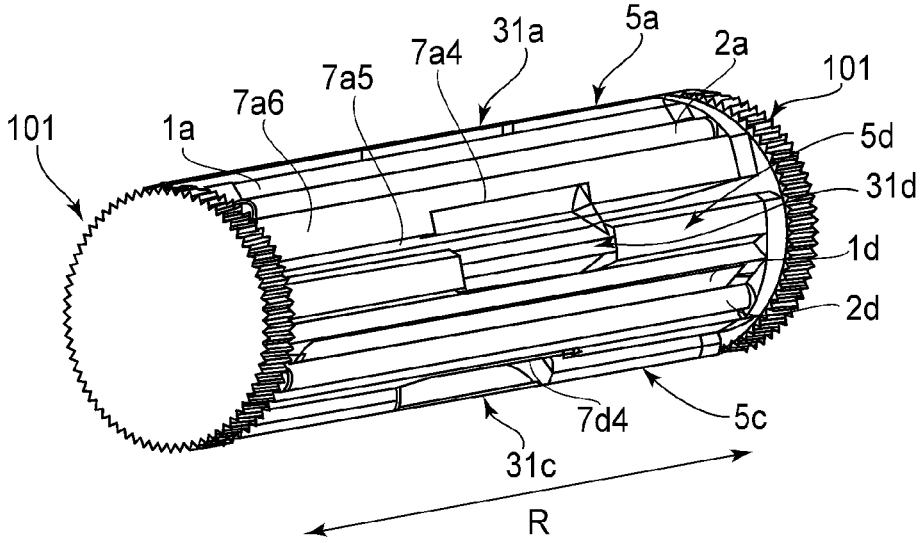
FIG. 8(*a*) is a perspective view showing a state in which developing cartridges of the present invention are mounted in a rotary, and FIG. 8(*b*) is a partial sectional view of the rotary.
Figure 8:
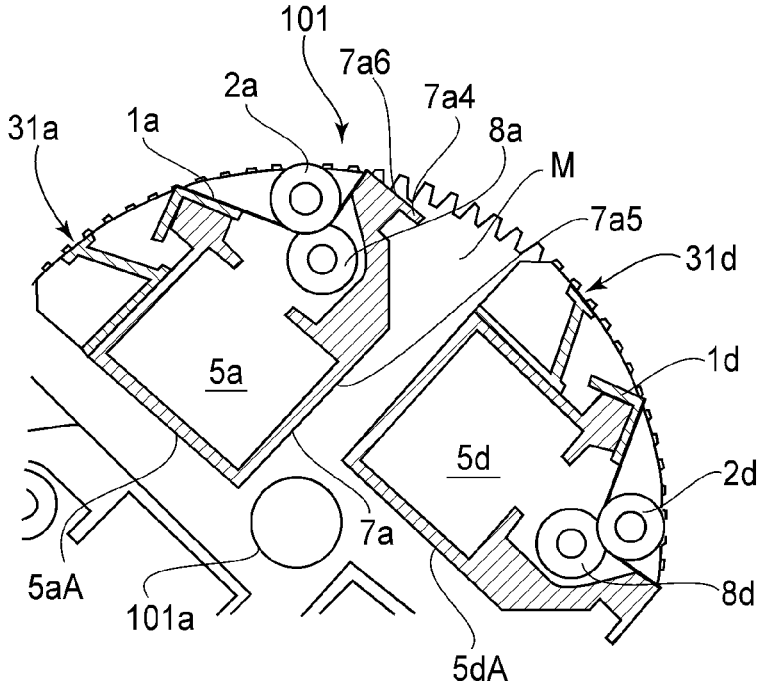

FIG. 6(*a*) is a perspective view showing a state in which the cover member 30*a* is attached to the yellow developing cartridge 5*a*. FIG. 6(*b*) is a perspective view showing a state in which the cover member 30*a* is detached from the yellow developing cartridge 5*a*. FIG. 7 is a sectional view of the developing cartridge 5*a* as seen in a direction perpendicular to the longitudinal direction (indicated by an arrow R in FIG. 6(*a*)) along the grip portion 31*a* provided in the neighborhood of the central portion of the yellow developing cartridge 5*a*. FIG. 8(*a*) is a perspective view showing a state in which the developing cartridges 5 are mounted in the rotary 101. FIG. 8(*b*) is a schematic sectional view showing the state in which the developing cartridges 5 are mounted in the rotary 101.

The yellow developing cartridge 5*a* engages with the cover member 30*a* at two portions including a grip-side portion to be engaged (first portion to be engaged) 31*a*1 provided on the grip portion 31*a* in the neighborhood of the longitudinal central portion and a container-side portion to be engaged (second portion to be engaged) 7*a*4 provided on the developing container 7*a* as shown in FIGS. 6(*b*) and 7.

Here, the container-side portion to be engaged 7*a*4 is, as shown in FIGS. 8(*a*) and 8(*b*), disposed at a position in which it opposes a grip portion 31*d* of the black developing cartridge 5*d* adjacent to the yellow developing cartridge 5*a* mounted in the rotary 101. That is, the container-side portion to be engaged 7*a*4 is positioned in the neighborhood of the longitudinal central portion of the yellow developing cartridge 5*a* and is provided at a position in which surface 7*a*5 and 7*a*6 of the developing container 7*a* are cut away.

This is because, as shown in FIG. 8(*b*), in a state in which the plurality of the developing cartridges 5 are mounted in the apparatus main assembly 11A, operativity of the adjacent black developing cartridge 5*d* can be improved. That is, in the case where the grip portion 31*d* is gripped in order to operate the black developing cartridge 5*d*, a space M is provided in order to improve a gripping property by separating the adjacent container-side portion to be engaged 7*a*4 from the grip portion 31*d*. In this embodiment, the constitution described above is employed in view of usability for the rotary type image forming apparatus.

Next, the cover member 30*a* will be described.

As shown in FIGS. 6(*b*) and 7, the cover member 30*a* engages with the yellow developing cartridge 5*a* at four engaging portions 30*a*1, 30*a*2, 30*a*3 and 30*a*4 provided in the neighborhood of the longitudinal central portion.

That is, the yellow developing cartridge 5*a* is provided with the grip portion-side portion to be engaged 31*a*1 on one end side of the frame 5*a*A and with the container-side portion to be engaged 7*a*4 or the other end side with respect to a direction crossing the longitudinal direction (i.e., the AD) of the developing roller 2*a*. Further, the engaging portions provided on the cover member 30*a*, i.e., the first engaging portions 30*a*1 and 30*a*2 of the cover member 30*a* engage with the grip portion-side portion to be engaged 31*a*1, and the second engaging portions 30*a*3 and 20*a*4 engage with the container-side portion to be engaged 7*a*4 of the developing container 7*a*, at the same time. As a result, the cover member 30*a* is applied to the developing cartridge 5*a* (FIG. 6(*a*)). At this time, the surface 30*a*5 of the cover member 30*a* does not contact the developing roller 2*a*.

Figure 9:
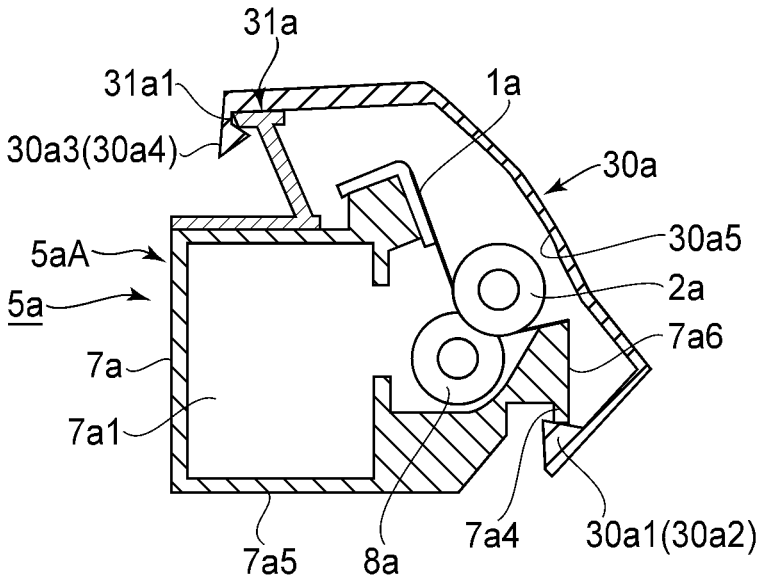
FIG. 9(*a*) is a schematic sectional view showing a state in which the cover member is attached to the developing cartridge of the present invention in a 180-degree turn state, and FIG. 9(*b*) is a perspective view of the developing cartridge.
Figure 9:
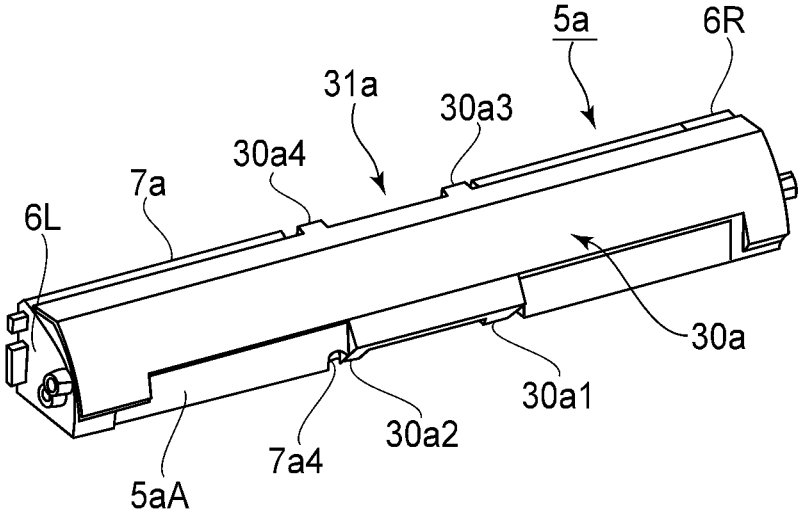

Further, the cover member 30*a* engages with the developing cartridge 5*a* at the portions to be engaged associated with the engaging portions described above but as shown in FIGS. 9(*a*) and 9(*b*), the engaging portions 30*a*1 and 30*a*2 can engage with the container-side portion to be engaged 7*a*4 and the engaging portions 30*a*3 and 30*a*4 can engage with the grip portion-side portion to be engaged 31*a*1, at the same time. That is, the cover member 30*a* can also be applied to the yellow developing cartridge 5*a* even in a 180-degree turn state of the cover member 30*a*.

That is, according to the present invention, the cover member 30*a* can be placed in a first state in which the first engaging portions 30*a*1 and 30*a*2 engage with the first portion to be engaged 31*a*1 and the second engaging portions 30*a*3 and 30*a*4 engage with the second portion to be engaged 7*a*4 to attach the cover member 30*a* to the frame 5*a*A. On the other hand, the cover member 30*a* can also be placed in a second state in which the first engaging portions 30*a*1 and 30*a*2 engage with the second portion to be engaged 7*a*4 and the second engaging portions 30*a*3 and 30*a*4 engage with the first portion to be engaged 31*a*1 to attach the cover member 30*a* to the frame 5*a*A.

This is because the grip portion-side portion to be engaged (first portion to be engaged) 31*a*1 and the developing container-side portion to be engaged (second portion to be engaged) 7*a*4 for forming the space M for improving the gripping property of the grip portion 31 in the image forming apparatus 11 are disposed at the same position with respect to the longitudinal direction. Further, even in the case where the cover member 30*a* is attached to the yellow developing cartridge 5*a* in the 180-degree turn state, the surface 30*a*5 of the cover member 30*a* is configured so as not to contact the developing roller 2*a*. Therefore, irrespective of the attaching direction of the cover member 30*a*, it is possible to protect the entire developing roller area exposed from the developing container 7*a*, i.e., the frame 5*a*A.

As described above, the developing cartridge 5 in this embodiment includes the grip portion-side portion to be engaged 31*a*1 and the container-side portion to be engaged 7*a*4 which are disposed in the neighborhood of the longitudinal central portion of the developing cartridge 5. As a result, the cover member 30*a* is configured to be attached to the developing cartridge 5 by engaging the engaging portions 30*a*1, 30*a*2, 30*a*3 and 30*a*4 with the portions to be engaged 31*a*1 and 7*a*4 at the same time, irrespective of the direction of the cover member 30*a*.

Therefore, when the user stores and sends back the developing cartridge 5 after use, the cover member 30*a* can be attached to the developing cartridge 5 easily. For that reason, the entire developing roller area exposed from the developing cartridge 5 can be protected, so that it is possible to compatibly realize the usability and easy recycling property of parts of the developing cartridge 5.

In this embodiment, the yellow developing cartridge 5*a* is described but the above description is also true for other developing cartridges 5*b* for magenta, 5*c* for cyan, and 5*d* for black.

Further, in this embodiment, the case of the color developing cartridges used in the rotary type electrophotographic image forming apparatus is described but the present invention is not limited thereto. For example, the present invention is also applicable to the developing cartridges or a monochromatic developing cartridge in the case of an in-line type image forming apparatus.

Embodiment 2

Mounting and Dismounting Constitution of Cover Member

The mounting and dismounting constitution of the cover member and the developing cartridge is the same with respect to all the developing cartridges, i.e., the yellow developing cartridge 5*a*, the magenta developing cartridge 5*b*, the cyan developing cartridge 5*c* and the black developing cartridge 5*d*. Therefore, the description of the mounting and dismounting constitution of the cover member in this embodiment will be made with respect to the yellow developing cartridge 5*a*.

Figure 10:
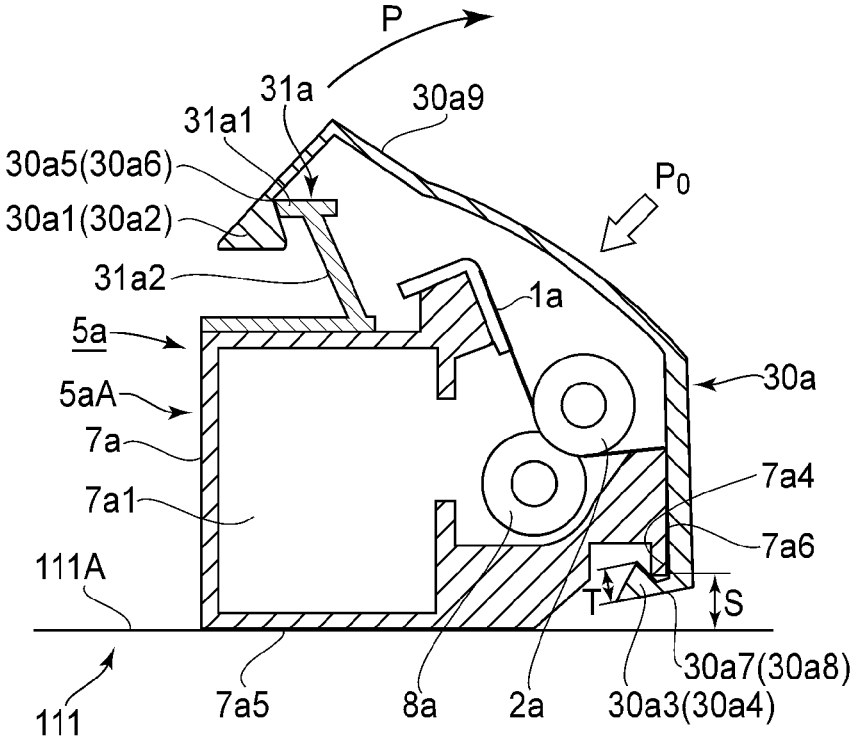
FIG. 10 is a schematic sectional view of the developing cartridge placed on a table in a state in which the cover member is attached to the developing cartridge.

FIG. 6(*a*) shows a state in which the cover member 30*a* is mounted on (attached to) the yellow developing cartridge 5*a*. FIG. 6(*b*) shows a state in which the cover member 30*a* is dismounted (detached) from the yellow developing cartridge 5*a*. FIG. 6(*c*) shows a state in which the cover member 30*a* is viewed from the inside thereof. FIG. 10 is a sectional view of the developing cartridge 5*a* as seen in a direction perpendicular to the longitudinal direction (i.e., the axial direction R in FIG. 6(*b*)) along the grip portion 31*a* provided in the neighborhood of the central portion of the yellow developing cartridge 5*a*.

In this embodiment, the yellow developing cartridge 5*a* is, as shown in FIGS. 6(*b*) and 10, provided with the grip portion 31*a* on one end side of the frame 5*a*A with respect to the direction crossing the longitudinal direction in the neighborhood of the longitudinal central portion and is provided with the grip portion-side portion to be engaged (first portion to be engaged) 31*a*1 on the grip portion 31*a*. On the other end side of the frame 5*a*A opposite from the side where the grip portion 31*a* is provided, the container-side portion to be engaged (second portion to be engaged) 7*a*4 is provided in the neighborhood of the longitudinal central portion while interposing the developing roller 2*a* between the portions 31*a*1 and 7*a*4. The yellow developing cartridge 5*a* engages with the cover member 30*a* at these two portions, i.e., the grip portion-side portion to be engaged 31*a*1 provided on the grip portion 31*a* and the container-side portion to be engaged 7*a*4 provided on the opposite side to the grip portion 31*a* side.

On the other hand, the cover member 30*a* includes, as shown in FIGS. 6(C) and 10, the four engaging portions 30*a*1, 30*a*2, 30*a*3 and 30*a*4 provided in the neighborhood of the longitudinal central portion. Further, the cover member 30*a* is attached to the yellow developing cartridge 5*a* by engaging the engaging portions (first engaging portions) 30*a*1 and 30*a*2 with the grip portion-side portion to be engaged 31*a*1 and by engaging the engaging portions (second engaging portions) 30*a*3 and 30*a*4 with the container-side portion to be engaged 7*a*4.

At this time, the two portions to be engaged, i.e., the grip portion-side portion to be engaged (first portion to be engaged) 31*a*1 and the container-side portion to be engaged (second portion to be engaged) 7*a*4 at least overlap with each other with respect to a direction perpendicular to the axial direction of the developing roller 2*a*. As a result, the cover member 30*a* can be easily attached to the frame 5*a*A by pushing a portion between the first engaging portion 30*a*1 (30*a*2) and the second engaging portion 30*a*3 (30*a*4) with respect to a direction indicated by an arrow $P_0$ in FIG. 10. FIG. 8(*a*) is a perspective view showing a state in which the developing cartridges 5 are mounted in the rotary 101. FIG. 8(*b*) is a schematic sectional view showing the state in which the developing cartridges 5 are mounted in the rotary 101.

The yellow developing cartridge 5*a* engages with the cover member 30*a* at two portions including a grip-side portion to be engaged 31*a*1 provided on the grip portion 31*a* in the neighborhood of the longitudinal central portion and a container-side portion to be engaged 7*a*4 provided on the developing container 7*a* as shown in FIGS. 6(*b*) and 10.

Here, the container-side portion to be engaged 7*a*4 is, as shown in FIGS. 8(*a*) and 8(*b*), disposed at a position in which it opposes a grip portion 31*d* of the black developing cartridge 5*d* adjacent to the yellow developing cartridge 5*a* mounted in the rotary 101. That is, the container-side portion to be engaged 7*a*4 is positioned in the neighborhood of the longitudinal central portion of the yellow developing cartridge 5*a* and is provided at a position in which surface 7*a*5 and 7*a*6 of the developing container 7*a* are cut away.

This is because, as shown in FIG. 8(*b*), in a state in which the plurality of the developing cartridges 5 is mounted in the apparatus main assembly 11A, operativity of the adjacent black developing cartridge 5*d* can be improved. That is, in the case where the grip portion 31*d* is gripped in order to operate the black developing cartridge 5*d*, a space M is provided in order to improve a gripping property by separating the adjacent container-side portion to be engaged 7*a*4 from the grip portion 31*d*. In this embodiment, the constitution described above is employed in view of usability for the rotary type image forming apparatus.

Here, as described above, the yellow developing cartridge 5*a* in the unused state is required that a toner seal 9*a* is removed and the cover member 30*a* is detached before use. In this embodiment, this operation before the use of the yellow developing cartridge 5*a* may preferably be performed in a state in which the yellow developing cartridge 5*a* is placed on a table (stage) 111 such as a horizontal table as shown in FIG. 10. FIG. 10 shows an attitude such that the yellow developing cartridge 5*a* is mounted on the table 111 so that a disposing surface 7*a*5 of the yellow developing cartridge 5*a* contacts a mounting surface 111A of the table 111. In this attitude, the grip portion 31*a* of the yellow developing cartridge 5*a* is most distant from the table 111. That is, the yellow developing cartridge 5*a* is mounted on the mounting surface 111A of the table 111 so that the grip portion-side portion to be engaged (first portion to be engaged) 31*a*1 is positioned above the container-side portion to be engaged (second portion to be engaged) 7*a*4.

In this attitude, the user grips the grip portion 31*a* and performs an operation for raising the yellow developing cartridge 5*a* from the table 111 or an operation for placing the yellow developing cartridge 5*a* on the table 111. Further, the grip portion 31*a* is provided with the portion to be engaged 31*a*1 for the cover member 30*a*, so that the mounting and dismounting operation of the cover member 30*a* with respect to the yellow developing cartridge 5*a* can also be performed by the operation of the grip portion 31*a*. Thus, the grip portion 31*a* has the functions of operating the yellow developing cartridge 5*a* and effecting the mounting and dismounting operation of the cover member 30*a*, so that the cover member 30*a* can be operated easily.

A constitution in which the cover member 30*a* is detached from the yellow developing cartridge 5*a* in the attitude described above will be described with reference to FIG. 10.

First, the cover member 30*a* is moved in a direction indicated by an arrow P with the container-side portion to be engaged 7*a*4 as the rotational movement center. At this time, engaging portion base portions 30*a*5 and 30*a*6 at the engaging portions 30*a*1 and 30*a*2 engaged with the grip portion-side portion to be engaged 31*a*1 are bent to release the engagement with the grip portion-side portion to be engaged 31*a*1. After the engagement of the engaging portions 30*a*1 and 30*a*2 with the grip portion-side portion to be engaged 31*a*1, the cover member 30*a* is rotationally moved about the engaging portions 30*a*3 and 30*a*4, so that the cover member 30*a* can be dismounted from the yellow developing cartridge 5*a*.

Next, by dismounting the engaging portions 30*a*3 and 30*a*4 from the container-side portion to be engaged 7*a*4, the cover member 30*a* can be detached from the yellow developing cartridge 5*a*. At this time, a height H of a claw portion of the engaging portions 30a3 and 30a4 is made smaller than a distance S between an end of the container-side portion to be engaged 7a4 and the disposing surface 7a5 of the developing container 7a. As a result, during the dismounting of the cover member 30a, the engaging portions 30a3 and 30a4 are prevented from interfering with the table 111 and the end of the container-side portion to be engaged 7a4.

Figure 11:
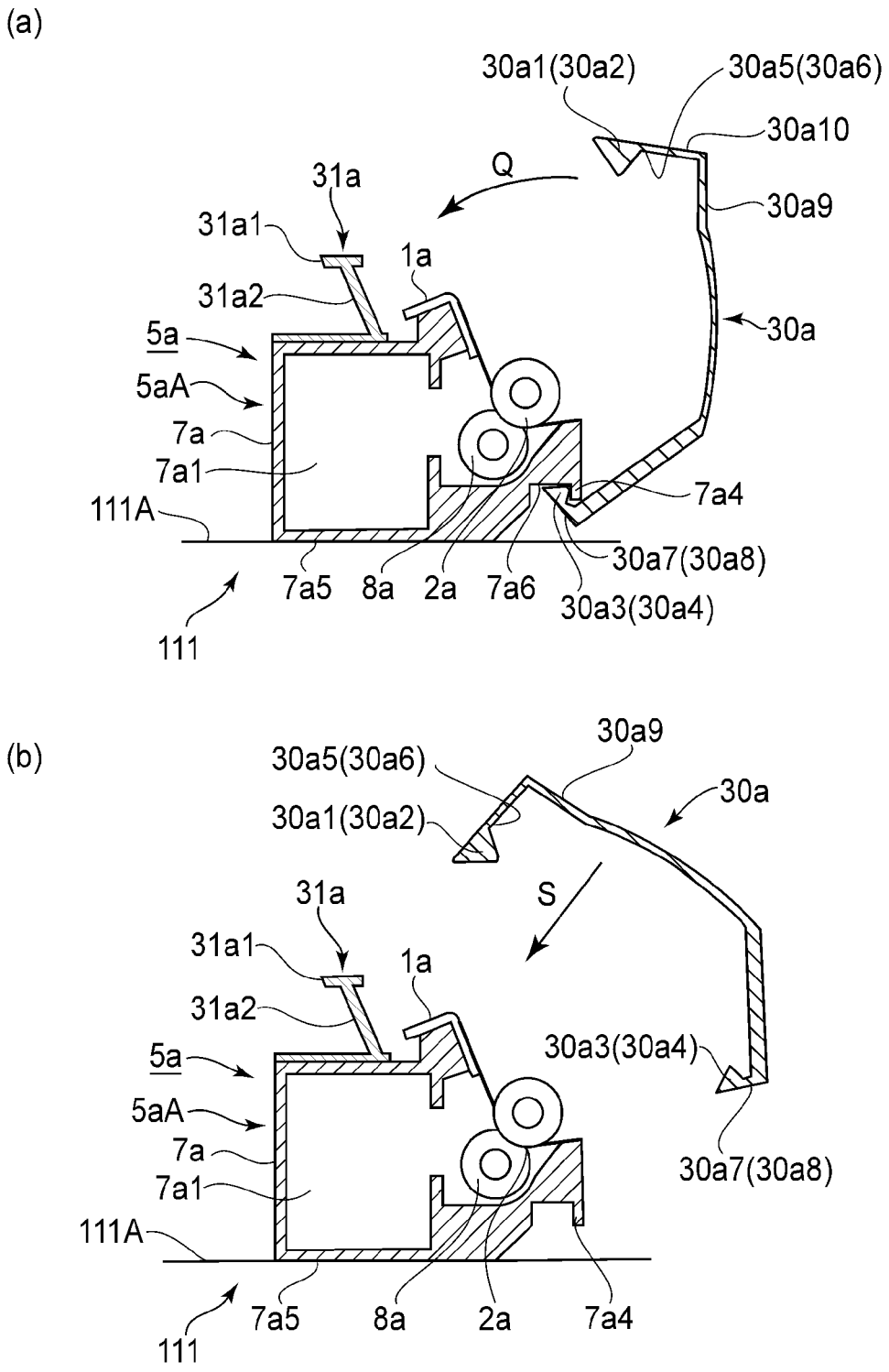
FIGS. 11(*a*) and 11(*b*) are schematic sectional views each for illustrating a manner of attaching the cover member to the developing cartridge of the present invention.

Further, a constitution in which the cover member 30a is attached to the yellow developing cartridge 5a is shown in FIG. 11(a).

Similarly as in the case of detaching the cover member 30a, the yellow developing cartridge 5a is placed on the table 111 so that its disposing surface 7a5 contacts the mounting surface 111A of the table 111. That is, the yellow developing cartridge 5a is placed on the mounting surface 111A of the table 111 so that the grip portion-side portion to be engaged 31a1 is positioned above the container-side portion to be engaged 7a4.

Then, the engaging portions 30a3 and 30a4 are engaged with the container-side portion to be engaged 7a4 and the cover member 30a is rotationally moved in a direction indicated by an arrow Q in FIG. 11(a) with the container-side portion to be engaged 7a4 as the rotational movement center. Then, the engaging portion base portions 30a5 and 30a6 of the engaging portions 30a1 and 30a2 are bent and engaged with the grip portion-side portion to be engaged 31a1. As a result, the cover member 30a is attached to the frame 5aA.

Further, the cover member 30a can also be attached to the yellow developing cartridge 5a by being moved in a direction indicated by an arrow S in FIG. 11(b) and by being engaged with the yellow developing cartridge 5a. That is, by the movement of the cover member 30a in the S direction, engaging portion base portions 30a5, 30a6, 30a7 and 30a8 of the engaging portions 30a1, 30a2, 30a3 and 30a4 of the cover member 30a are bent. Then, the engaging portions 30a1 and 30a2 of the cover member 30a are engaged with the grip portion-side portion to be engaged 31a1, and the engaging portions 30a3 and 30a4 of the cover member 30a is engaged with the container-side portion to be engaged 7a4.

In this embodiment, the mounting and dismounting of the cover member 30a with respect to the yellow developing cartridge 5a in the state in which the yellow developing cartridge 5a is placed on the table 111 so that the disposing surface 7a5 contacts the mounting surface 111A is described. However, the mounting and dismounting of the cover member 30a with respect to the yellow developing cartridge 5a can also be effected in one hand while holding the yellow developing cartridge 5a in the other hand.

Figure 12:
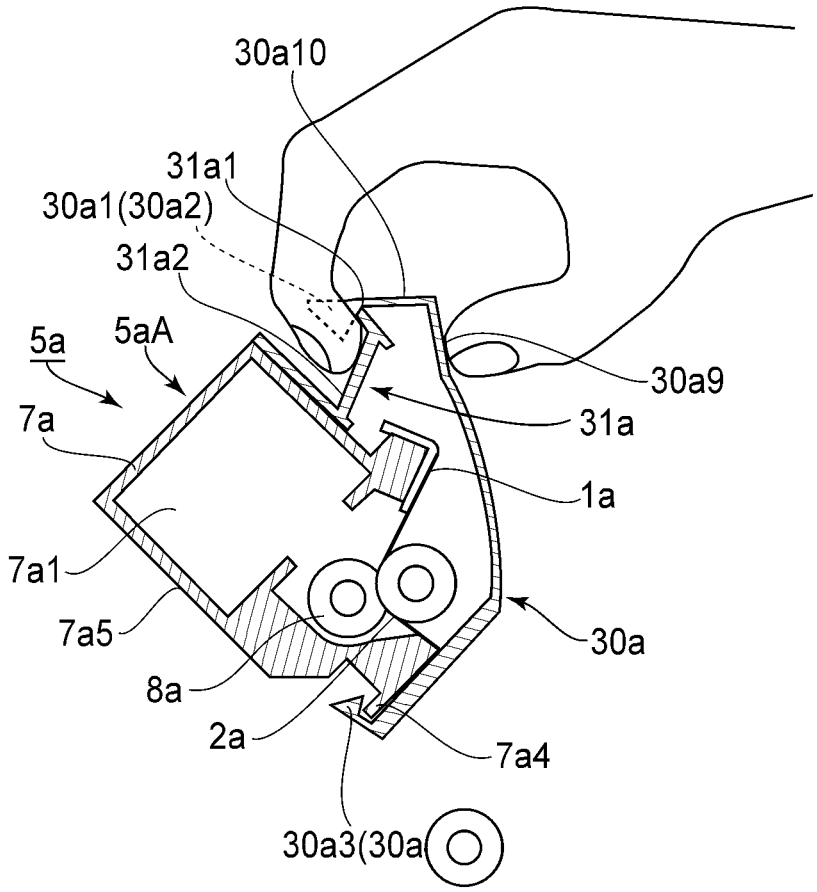
FIG. 12 is a schematic sectional view for illustrating a gripping method when the cover member is attached to the developing cartridge of the present invention.

FIG. 12 is a sectional view of the yellow developing cartridge 5a covered with the cover member 30a as seen in a direction perpendicular to the longitudinal direction passing through the grip portion 31a provided in the neighborhood of the longitudinal central portion of the yellow developing cartridge 5a.

In the yellow developing cartridge 5a having a small rotary constitution as in this embodiment, the grip portion 31a and the developing roller 2a protected by the cover member 30a are disposed close to each other. In such a constitution, when the cover member 30a for protecting the developing roller 2a is provided, the grip portion 31a itself is covered with the cover member 30a, so that it is difficult to grip only the grip portion 31a in some cases.

In this embodiment, as shown in FIG. 12, the cover member 30a also has the function as the grip portion 31a. The cover member 30a is provided with a cover member grip surface 30a9 and in the state in which the yellow developing cartridge 5a is covered with the cover member 30a, the user can grip a grip portion grip surface 31a2 and the cover member grip surface 30a9 together, so that the grip portion for the yellow developing cartridge 5a is formed.

Figure 13:
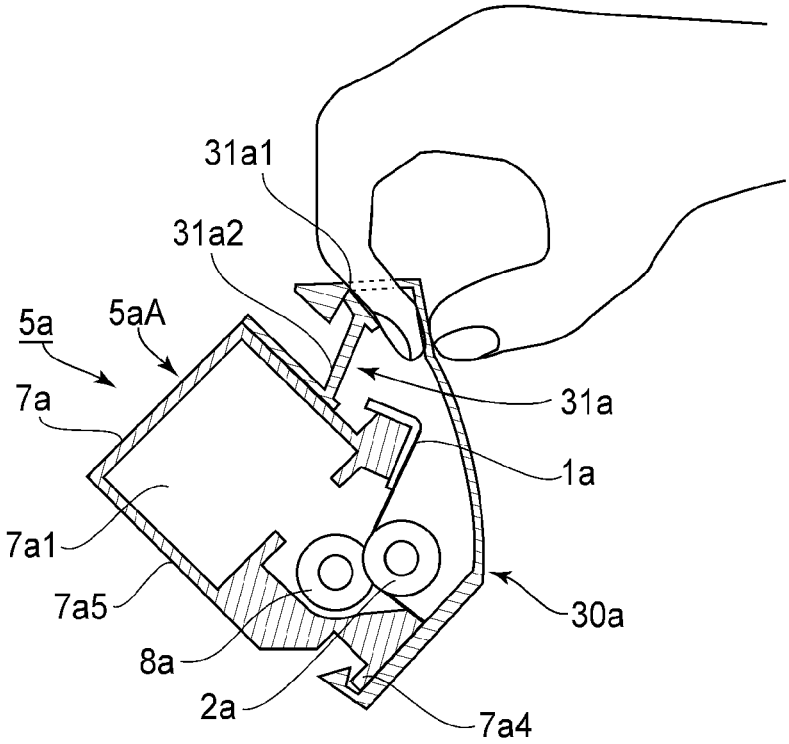
FIG. 13 is a schematic sectional view for illustrating a gripping method when the cover member is attached to the developing cartridge of the present invention.

As a result, e.g., as shown in FIG. 13, an adverse effect in the case where only the cover member 30a is gripped is eliminated. That is, drop of the yellow developing cartridge 5a caused by disengagement between the yellow developing cartridge 5a and the cover member 30a when the user grips only the cover member 30a is prevented. Further, in order to prevent the detaching of the cover member 30a from the yellow developing cartridge 5a, there is no need to increase a mounting and dismounting force caused in the case where an engaging force of the engaging portions is strengthened. Therefore, usability is improved according to this constitution.

Figure 14:
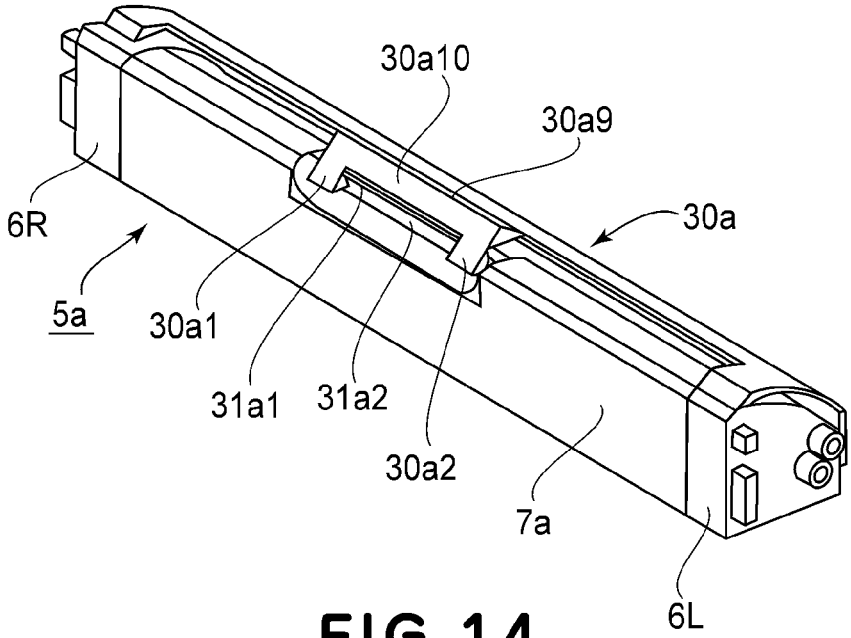
FIG. 14 is a perspective view showing the developing cartridge of the present invention and a grip portion of the cover member.

Further, as shown in FIG. 14, a cover surface 30a10 is provided between the grip portion grip surface 31a2 and the cover member grip surface 30a9 which form the grip portion in the case where the yellow developing cartridge 5a is held. This cover surface 30a10 extends to a position close to the grip portion-side portion to be engaged 31a1 to prevent fingers to enter a gap between the grip portion grip surface 31a2 and the cover member grip surface 30a9. As a result, the user can easily grip the cover member 30a and the grip portion 31a together.

As described above, the engaging portions of the cover member 30a detachably mountable to the yellow developing cartridge 5a are concentrated at a position in the neighborhood of the grip portion 31a for operating the yellow developing cartridge 5a, so that the user's operation can be concentrated at the grip portion 31a. As a result, the mounting and dismounting operation by one hand can be effected. Further, the operating portion and the grip portion are configured as a single portion, thus being easily recognized by the user, so that it is possible to provide the yellow developing cartridge 5a provided with the cover member 30a having good usability. This is also true for other developing cartridges 5b for magenta, 5c for cyan, and 5d for black.

Further, in this embodiment, the case of the color developing cartridges used in the rotary type electrophotographic image forming apparatus is described but the present invention is not limited thereto. For example, the present invention is also applicable to the developing cartridges or a monochromatic developing cartridge in the case of an in-like type image forming apparatus.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 250619/2009 filed Oct. 30, 2009, and 250706/2009 filed Oct. 30, 2010, which are hereby incorporated by reference.

What is claimed is:

1. A developing cartridge detachably mountable to a main assembly of an image forming apparatus, said developing cartridge comprising:

a frame;

a developer carrying member, provided on said frame, for carrying a developer for developing an electrostatic image;

a first portion to be engaged provided on one side of said frame with respect to a direction crossing an axial direction of said developer carrying member;

a second portion to be engaged provided on another side of said frame with respect to the direction crossing the axial direction of said developer carrying member; and a cover member, including a first engaging portion engageable with said first portion to be engaged and including a second engaging portion engageable with said second portion to be engaged, for covering an exposed portion of said developer carrying member by being detachably mounted to said frame, wherein said cover member is detachably mountable to said frame in a first state by engaging the first engaging portion with said first portion to be engaged and by engaging the second engaging portion with said second portion to be engaged, and wherein said first portion to be engaged is positioned above said second portion to be engaged in a state in which said developing cartridge is disposed so that a disposing surface opposes a mounting surface on which said developing cartridge is to be mounted, wherein the second engaging portion includes a claw portion, and wherein said claw portion has a height which is smaller than a distance from the mounting surface to said second portion to be engaged.

2. A cartridge according to claim 1, further comprising a grip portion provided on said frame, wherein said first portion to be engaged is provided on said grip portion.

3. A cartridge according to claim 2, wherein when a plurality of developing cartridges are mounted in the main assembly of the image forming apparatus, said second portion to be engaged is provided at a position in which it opposes a grip portion provided on an adjacent developing cartridge.

4. A cartridge according to claim 1, wherein said cover member is configured so as not to contact the exposed portion of said developer carrying member in both the first state, in which the first engaging portion engages with said first portion to be engaged and the second engaging portion engages with said second portion to be engaged, and in a second state, in which the first engaging portion engages with said second portion to be engaged and the second engaging portion engages with said first portion to be engaged.

5. A cartridge according to claim 1, wherein in the case where said cover member is mounted to said frame in a state in which the first engaging portion engages with said first portion to be engaged and the second engaging portion engages with said second portion to be engaged, said cover member is configured, when being dismounted from said frame, to release the engagement of the second engaging portion after the engagement of the first engaging portion is released and then said cover member is rotated about the second engaging portion.

6. A cartridge according to claim 1, wherein said first portion to be engaged and said second portion to be engaged are provided at positions in which at least a part of said first portion to be engaged overlaps with a part of said second portion to be engaged with respect to a direction perpendicular to the axial direction of said developer carrying member.

7. A cartridge according to claim 1, wherein said cover member is detachably mountable to said frame in a second state by engaging the first engaging portion with said second portion to be engaged and by engaging the second engaging portion with said first portion to be engaged.

8. A cartridge according to claim 1, wherein with respect to the direction crossing the axial direction of said developer carrying member, said first portion to be engaged and said second portion to be engaged are provided in a position to at least partly overlap each other.

9. A developing cartridge detachably mountable to an electrophotographic image forming apparatus for forming an image on a recording material, said developing cartridge comprising:

a developer carrying member for developing a latent image formed on an image bearing member;

a frame including a cut-away portion at a longitudinal central portion thereof and including, with respect to a direction crossing an axial direction of said developer carrying member, a first portion to be engaged provided on one side of said frame and a second portion to be engaged provided on another side of said frame in a position of said cut-away portion; and a cover member, including a first engaging portion and a second engaging portion, detachably mounted to said frame for covering an exposed portion of said developer carrying member exposed from said frame, wherein said cover member is capable of being placed in a first state in which said cover member is mounted to said frame by engaging the first engaging portion with said first portion to be engaged and by engaging the second engaging portion with said second portion to be engaged, and a second state in which said cover member is mounted to said frame by engaging the first engaging portion with said second portion to be engaged and by engaging the second engaging portion with said first portion to be engaged.

10. A cartridge according to claim 9, further comprising a grip, provided on said frame, for gripping said developing cartridge, wherein said first portion to be engaged is provided on said grip.

11. A cartridge according to claim 9, wherein when a plurality of developing cartridges are mounted in a main assembly of the electrophotographic image forming apparatus, said second portion to be engaged is provided in a position in which it opposes a grip provided on the adjacent developing cartridge for gripping an adjacent developing cartridge.

12. A cartridge according to claim 9, wherein said first portion to be engaged and said second portion to be engaged are disposed at the longitudinal central portion of said frame.

13. A developing cartridge detachably mountable to an electrophotographic image forming apparatus for forming an image on a recording material, said developing cartridge comprising:

a developer carrying member for developing a latent image formed on an image bearing member;

a frame including, with respect to a direction crossing an axial direction of said developer carrying member, a first portion to be engaged provided on one side of said frame and a second portion to be engaged provided on another side of said frame;

a cover member, including a gripping surface for being gripped, a first engaging portion and a second engaging portion, detachably mounted to said frame for covering an exposed portion of said developer carrying member exposed from said frame; and a grip having a grip holding surface, wherein, in a state in which said developing cartridge is placed on a mounting surface so that said first portion to be engaged is provided above said second portion to be engaged, said cover member is capable of being mounted to said frame by engaging the first engaging portion with said first portion to be engaged and by engaging the second engaging portion with said second portion to be engaged, and wherein when said cartridge is gripped, the gripping surface and the grip holding surface are gripped together.

14. A cartridge according to claim 13, wherein said first portion to be engaged is provided on said grip, provided on said frame, for gripping said developing cartridge.

15. A cartridge according to claim 13, wherein when a plurality of developing cartridges are mounted in a main assembly of the electrophotographic image forming apparatus, said second portion to be engaged is provided in a position in which it opposes a grip provided on the adjacent developing cartridge for gripping an adjacent developing cartridge.

16. A cartridge according to claim 13, wherein said cover member is capable of being disengaged, after disengaging the first engaging portion, from said developing cartridge about the second engaging portion as a rotation center.

17. A cartridge according to claim 13, wherein said cover member has a cover surface for preventing a finger from entering a space between the gripping surface and the grip holding surface.

18. A cartridge according to claim 13, wherein the second engaging portion includes a claw portion, and wherein said claw portion has a height which is smaller than a distance from the mounting surface to said second portion to be engaged.

19. A developing cartridge detachably mountable to an electrophotographic image forming apparatus for forming an image on a recording material, said developing cartridge comprising:

a developer carrying member for developing a latent image formed on an image bearing member;

a frame including, with respect to a direction crossing an axial direction of said developer carrying member, a first portion to be engaged provided on one side of said frame and a second portion to be engaged provided on another side of said frame; and a cover member, including a first engaging portion and a second engaging portion, detachably mounted to said frame for covering an exposed portion of said developer carrying member exposed from said frame;

wherein, in a state in which said developing cartridge is placed on a mounting surface so that said first portion to be engaged is provided above said second portion to be engaged, said cover member is capable of being mounted to said frame by engaging the first engaging portion with said first portion to be engaged and by engaging the second engaging portion with said second portion to be engaged, wherein the second engaging portion includes a claw portion, and wherein said claw portion has a height which is smaller than a distance from the mounting surface to said second portion to be engaged.

* * * * *